US005460550A

United States Patent [19]

Okayasu et al.

[11] Patent Number: 5,460,550

[45] Date of Patent: Oct. 24, 1995

[54] CONNECTOR

[75] Inventors: Yasushi Okayasu; Atsushi Sakatani; Osamu Sasai; Akihito Maegawa, all of Yokkaichi, Japan

[73] Assignee: Sumitomo Wiring Systems, Ltd., Japan

[21] Appl. No.: 299,913

[22] Filed: Sep. 1, 1994

[30] Foreign Application Priority Data

Sep. 16, 1993 [JP] Japan ..... 5-055259 U

[51] Int. Cl.[6] ..... H01R 13/436

[52] U.S. Cl. ..... 439/752

[58] Field of Search ..... 439/595, 752

[56] References Cited

U.S. PATENT DOCUMENTS 5,057,042 10/1991 Yamanashi et al. ..... 439/752
5,120,269 6/1992 Endo et al. ..... 439/752
5,160,283 11/1992 Fry et al. ..... 439/752

*Primary Examiner*—Gary F. Paumen
*Attorney, Agent, or Firm*—Jordan B. Bierman; Bierman and Muserlian

[57] ABSTRACT

This invention provides a connector which can receive a terminal member easily and positively. In the connector, a retainer 10 is provided on each engaging portion 12 with a guide ramp face 20 which is opposed to a cavity 2 at a temporary locking position. A terminal member 30 is pushed into the cavity 2 when the retainer is at the temporary locking position. The member 30 does not enter into an opening 6 on account of the correcting action of the guide ramp face 20, even if the terminal member 30 is pushed toward the opening 6. After the distal end of the terminal member 30 passes over the guide ramp face 20, and outer periphery of the terminal member 30 is pushed down by a front end of the face 20. Consequently, the terminal member 30 is prevented from entering into the opening 6 and moves in the proper passage.

2 Claims, 4 Drawing Sheets

CONNECTOR

BACKGROUND OF THE INVENTION

1. Field of the Invention

This invention relates to a connector in which a terminal member is brought into a dual locking state by a first locking means in a cavity in a connector housing and a second locking means on a retainer.

2. Statement of the Prior Art

Heretofore, such connector comprised a connector housing provided in its interior with a plurality of cavities and in its exterior with a plurality of openings which are communicated with the cavities respectively, a plurality of terminal members each of which is inserted into a plurality of first locking means such as elastic locking pieces and the like each of which is disposed in each cavity, and a retainer mounted on the opening.

Upon attaching the terminal member to the connector, the terminal member is inserted into the cavity in the connector housing on which the retainer is not mounted and the first locking means in the cavity holds the terminal member in a first locking state. Thereafter, the retainer is mounted on the openings so that the projections on the retainer engage with the terminal member, thereby holding it in a second locking state. Thus, the terminal member is brought into a dual locking state and is positively locked in the cavity so as not to come out of it.

In such a conventional connector, since the retainer is not mounted on the opening upon insertion of the terminal member, an inner wall of the cavity is cut off around the opening.

Consequently, in the case where the terminal member is inserted into the cavity while it is inclined, the terminal member may be advanced toward the opening out of a proper insertion passage and may strike on an inner wall of the opening. In such cases, it is necessary to try the insertion procedure again.

In such circumstances an automatic process is engaged by using a device for inserting the terminal member into the cavity and are also of a manual process. Thus, it is necessary to set the position and the direction of the terminal member at a high accuracy and a skilled workperson is required in order to carry out the insertion work of the terminal member precisely and effectively.

SUMMARY OF THE INVENTION:

An object of the present invention is to provide a connector which can carry out an insertion of the terminal member precisely and effectively even if the position and the direction of the terminal member are not set at a high accuracy or even if a workperson is not highly skilled.

In order to achieve the above object, in a connector of the present invention, a connector housing is provided in its interior with a plurality of cavities each adapted to receive each terminal member, the housing is provided in its exterior with a plurality of openings each of which communicates with each corresponding cavity, and each terminal member is brought into a dual locking state by a first engaging means in the cavity and a second engaging means on a retainer. The connector is characterized in that the retainer is mounted on the openings at a temporary locking position where each terminal member is allowed to be inserted into and withdrawn from the cavity and a regular position where each terminal member is brought into the dual locking state; and that the retainer is provided with a plurality of guiding means each of which assures each terminal member to be inserted into the cavity at the temporary position.

The retainer may be united to the connector housing through a flexible hinge or may be separated from the connector housing.

Upon attaching the terminal member to the connector, the retainer is mounted at the temporary position on the opening and the terminal member is inserted into the cavity. The terminal member is advanced on the proper passage in the cavity while the terminal member is prevented from entering into the opening by the guidance of the retainer. When the terminal member reaches the final insertion position, the terminal member is locked in the cavity by the first locking means. Thereafter, when the retainer is mounted from the temporary locking position to the regular locking position, the terminal member is brought into the dual locking state in the cavity.

As described above, according to the present invention, it is possible to carry out the insertion of the terminal member precisely and effectively, even if the position and direction of the terminal are not set at the high accuracy or even if the workperson is not highly skilled, since the terminal member can move on the proper passage in the cavity by means of the guidance of the retainer.

Figure 1:
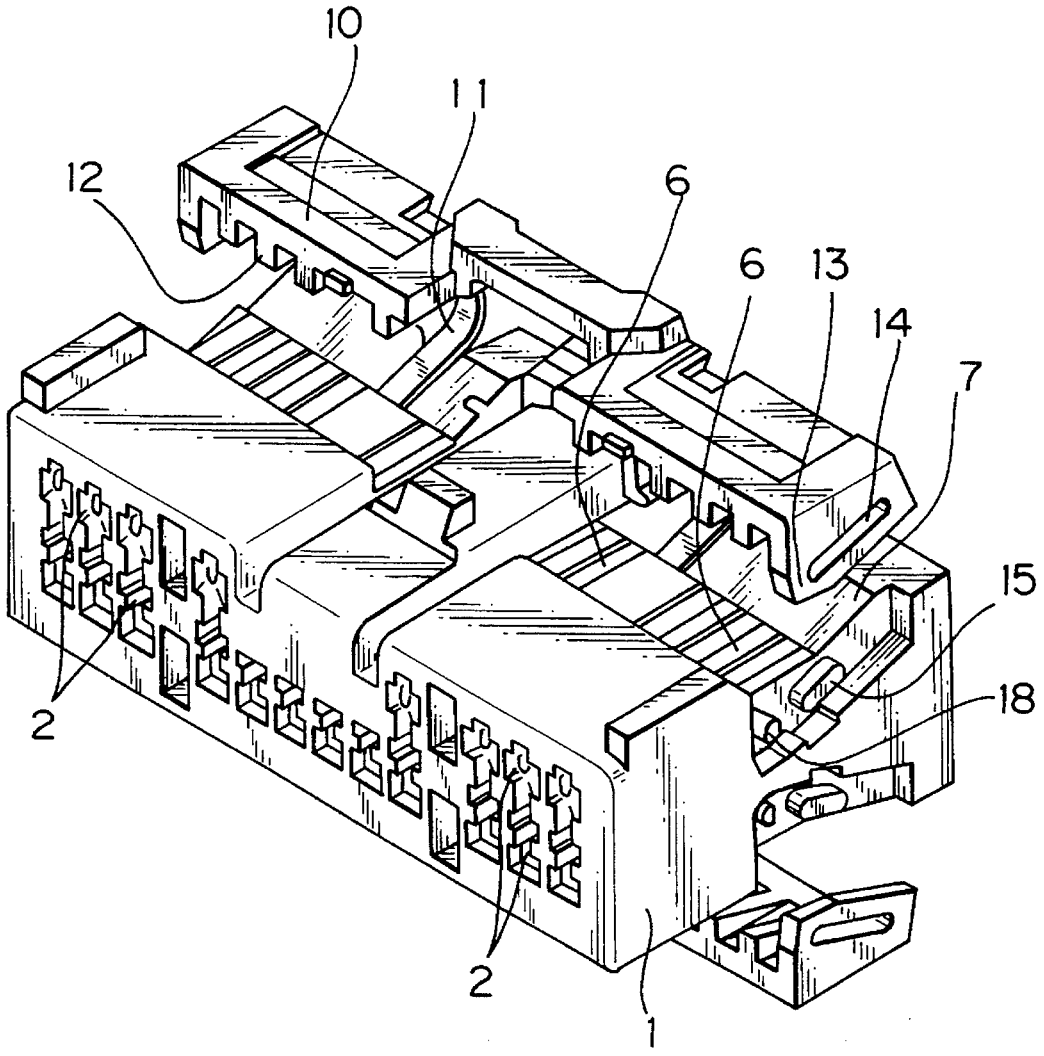
FIG. 1 is a perspective view of a connector of the present invention.

DETAILED DESCRIPTION OF THE PREFERRED EMBODIMENTS:

An embodiment of a connector in accordance with the present invention will be explained below by referring to the drawings.

Figure 2:
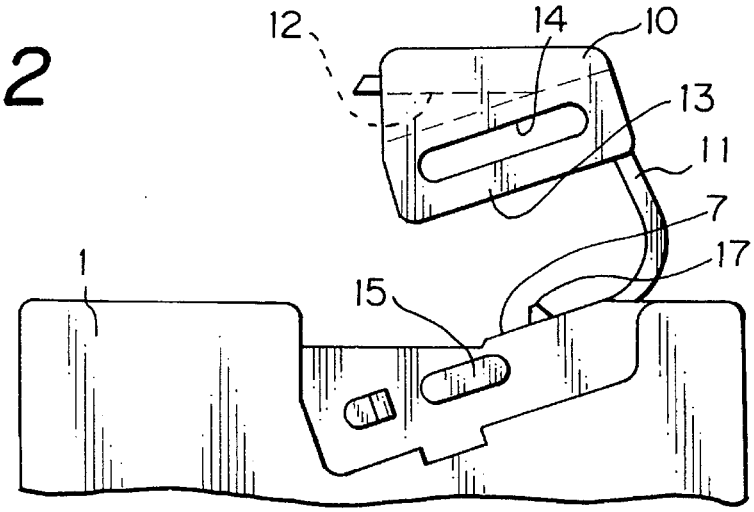
FIG. 2 is a side elevational view of a retainer, illustrating the formed state of the retainer.
Figure 5:
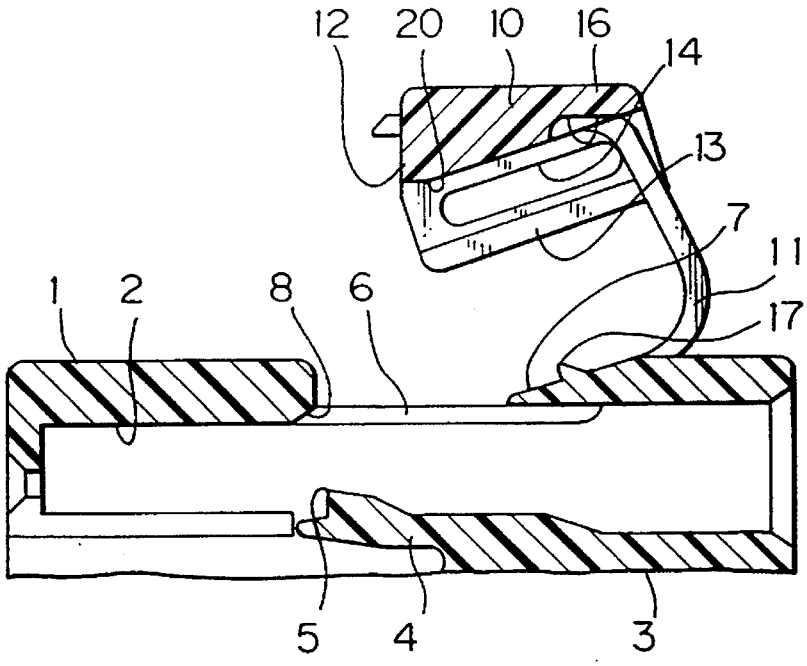
FIG. 5 is a longitudinal sectional view of the retainer, illustrating the formed state of the retainer.
Figure 6:
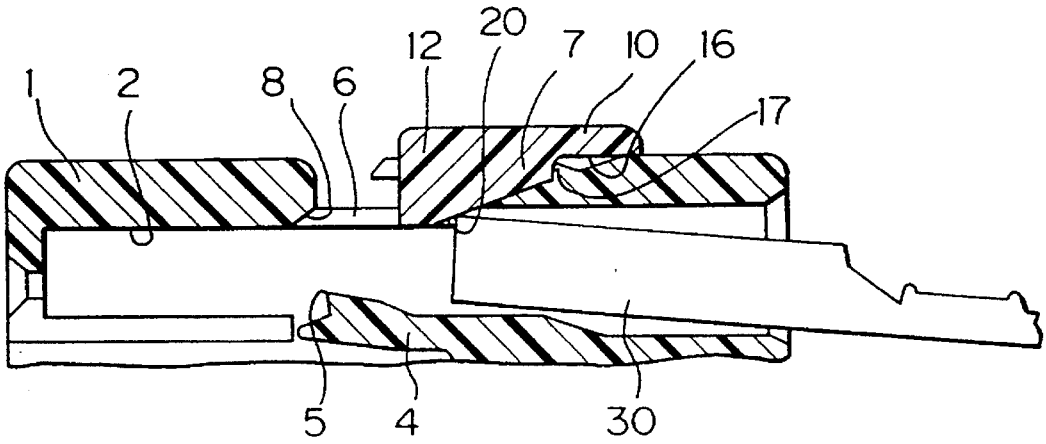
FIG. 6 is a longitudinal sectional view of the retainer, illustrating the temporary locking position of the retainer and the half inserting position of a terminal member.

As shown in FIGS. 1, 2 and 5, a connector housing 1 is provided in its interior with a plurality of cavities 2 adapted to receive each female terminal member 30 (FIG. 6). The cavities 2 are juxtaposed symmetrically on upper and lower stages in the housing 1. A partition 3 between the upper cavity 2 and the lower cavity 2 is provided on its opposite faces with an elastic lock piece 4 which serves as a first locking means. A projection 5 on the elastic lock piece 4 projects into the cavity 2 to engage with the first locking hole 31 in the terminal member 30. The engagement of the projection 5 with the hole 31 can constrain the terminal member 30 from coming out of the cavity 2.

The connector housing 1 is provided on this exterior with openings 6 through which the interior of the housing communicate with the exterior and support the retainer 10 which serves as a second locking means. The connector housing 1 is provided on a rear end of the opening 6 with a ramp face 7. The ramp face 7 serves to guide the retainer 10 when the retainer 10 moves between the temporary locking position and the regular locking position. The opening 6 is provided on its front end with a chamfered edge face 8 which is opposed to the cavity 2.

The retainer 10 to be mounted on the opening 6 is united to the connector housing 1 through a flexible hinge 11. In a free state as shown in FIGS. 2 and 5, the hinge 11 extends so that the retainer 10 is spaced away from the outer face of the connector housing 1. The retainer 10 is provided with a plurality of engaging portions 12 which slide on the ramp face 7 and are adapted to be inserted into the openings 6.

The retainer 10 is provided on its opposite sides with a side plate 13 having an elongated slot 14. On the other hand, the connector housing 1 is provided on its opposite sides with a guide boss 15. The retainer 10 receives the guide boss 15 slidably while being elastically deformed so that the retainer 10 is mounted on the connector housing 1. The retainer 10 is guided on the ramp face 7 between the temporary locking position and the regular locking position when the retainer 10 is mounted on the connector housing 1 so that the guide boss 15 engages with the elongated slot 14.

Figure 3:
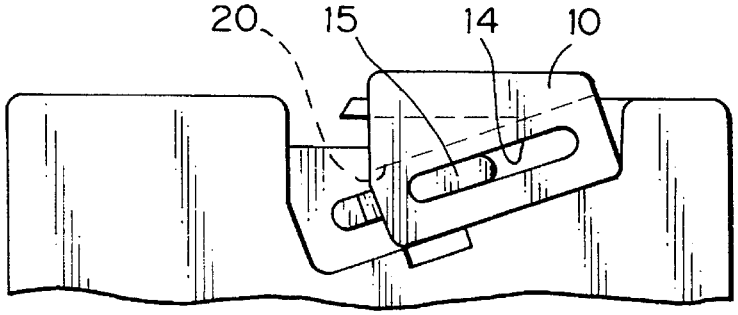
FIG. 3 is a side elevational view of the retainer, illustrating the temporary locking position of the retainer.
Figure 7:
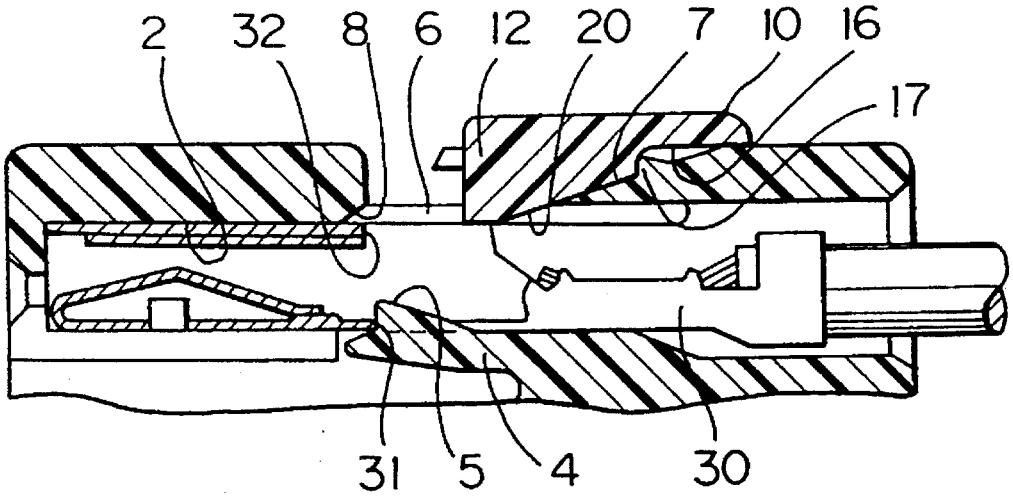
FIG. 7 is a longitudinal sectional view of the retainer, illustrating the temporary locking position of the retainer and the complete inserting position of the terminal member.

When the retainer 10 is at the temporary locking position, the guide boss 15 abuts on the front end of the elongated slot 14 in the retainer 10 as shown in FIG. 3. The retainer 10 is unable to move out of the connector housing 1 and is able to move toward the regular locking position. At the temporary locking position, the retainer 10 is held unslidably by an engagement of a temporary locking boss 17 on the ramp face 7 with a temporary locking recess 16 in the engaging portion 12, as shown in FIGS. 6 and 7. The engaging portion 12 of the retainer 10 is inserted into the opening 6. The distal end of the engaging portion 12 does not project into the cavity 2 and is disposed on an extension of the inner wall.

Figure 4:
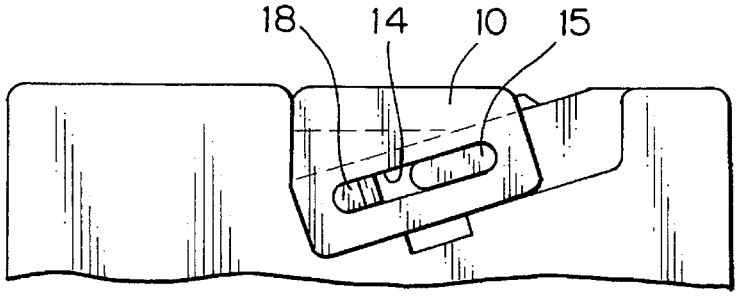
FIG. 4 is a side elevational view of the retainer, illustrating the regular locking position of the retainer.
Figure 8:
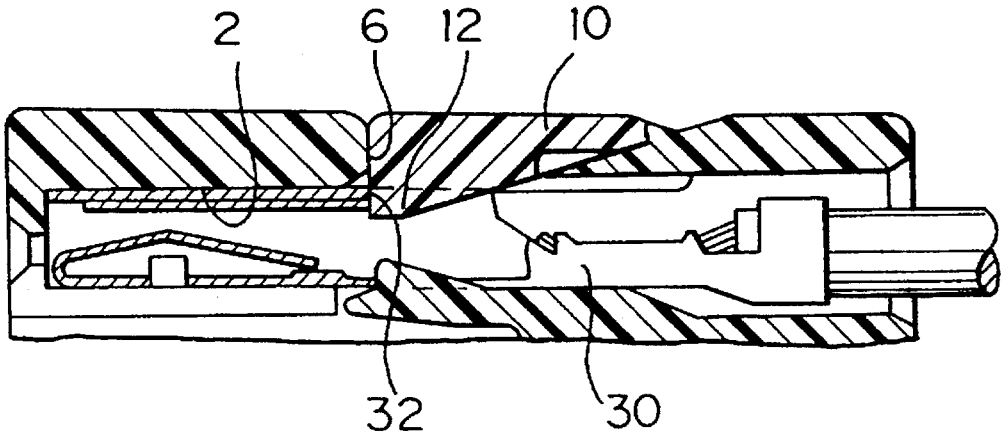
FIG. 8 is a longitudinal sectional view of the retainer, which is at the regular locking position to bring the terminal member into the dual locking position.

When the retainer 10 is advanced from the temporary locking position, the side plate 13 clears a regular locking boss 18 which is disposed on a front side from the guide boss 15 while being elastically deformed and reaches the regular locking position. At the regular locking position, the regular locking boss 18 abuts on the front end of the elongated slot 14, as shown in FIG. 4. The guide boss 15 abuts on a rear end of the elongated slot 14. As shown in FIG. 8, a front end of the engaging portion 12 of the retainer 10 abuts on a front end of the opening 6. These abutments hold the retainer 10 in an unslidable state.

When the retainer 10 moves to the regular locking position, the distal end of the engaging portion 12 projects into the cavity 2, as shown in FIG. 8, to engage with the second engaging hole 32 in the terminal member 30, thereby bringing the terminal member 30 into the dual locking state.

The engaging portion 12 of the retainer 10 is provided with a guide face 20 which guides the terminal member 30 in the cavity. The guide face 20 closes a rear part of the openings 6 and is opposed to the interior of the cavity 2, when the retainer 10 is at the temporary position. The guide face 20 is inclined forwardly, namely in an insertion direction of the terminal member 30.

Next, an operation of this embodiment will be explained below.

Before the terminal member 30 is inserted into the cavity 2, the retainer 10 is mounted from the free position shown in FIGS. 2 and 5 to the temporary locking position on the opening shown in FIGS. 3, 6 and 7. Then, the terminal member 30 is inserted into the cavity 2.

The terminal member 30 may move toward the opening 6 from the proper direction shown by a one dot chain line in FIG. 6 during insertion of the terminal member. However, the terminal member 30 is prevented from entering into the opening 6, since the distal end of the terminal member 30 slides on the guide face 20 of the retainer 10.

After the distal end of the terminal member 30 has passed over the guide face 20 on the retainer, the terminal member 30 advances while elastically deforming the elastic lock piece 4. An elastic recovery force exerted by the piece 4 acts on the terminal member 30 to push it onto the opening 6 from the cavity 2. However, the terminal member 30 is prevented from entering into the opening 6 since the front end of the guide face 20 suppresses the terminal member 30, even if the force from the elastic lock piece 4 acts on it.

Even if the terminal member 30 is inclined toward the opening 6 due to a clearance between the member 30 and the cavity 2, the terminal member 30 does not strike the inner wall of the opening 6, since the distal end of the member 30 slides on the chamfered portion 8 of the opening 6 to be guided into the cavity 2.

Thus, the terminal member 30 advances on the proper passage in the cavity until it reaches the final insertion position. At the same time, the projection 5 of the elastic lock piece 4 engages with the first locking hole 31 in the terminal member 30 to bring it into the first locking state.

Thereafter, when the retainer 10 is moved to the regular locking position, the distal end of the engaging portion 12 projected into the cavity 2 engages with the second locking hole 32 in the terminal member 30 to hold it at the second locking position. Consequently, the terminal member 30 is brought into the dual locking state so that the member 30 cannot come out of the cavity 2.

According to the present invention, since the terminal member 30 is guided on the proper passage upon insertion of it, the terminal member 30 does not strike on the edge of the opening 6. Accordingly, in the case where the terminal member 30 is automatically inserted into the cavity 2 by any inserting machine or in the case of manual work, it is possible to insert the terminal member 30 easily and positively, even if the insertion position and direction of the member 30 are not set at a high accuracy or even if the workperson is not fully skilled.

It should be noted that the present invention is not limited to the above embodiment. The present invention may be altered by the following forms, for example: (a) In the above embodiment, the retainer 10 is united to the connector housing 1 through the hinge 11. The retainer 10 may be separated from the connector housing 1. (b) In the above embodiment, the female terminal member 30 is inserted into the connector housing 1. A male terminal connector may be inserted into the housing.

The present invention should not be limited to the embodiment described above and illustrated in the drawings. The present invention may be altered without deviating from the spirit of the invention.

What is claimed is:

1. A connector comprising a housing and a retainer, said housing having a rear end, a front end, and housing sides therebetween, each of a plurality of cavities in said housing extending from said rear end to said front end and having an opening at said rear end, each of said cavities adapted to receive a corresponding terminal, ramp face on said housing adjacent said rear end of at least two of said cavities, said ramp faces adapted to guide said retainer between a temporary locking position and a secured locking position, first engaging elements in said cavities and including elastic lock pieces projecting into said cavities and adapted to engage respective locking holes in said terminals while said retainer is in said temporary position, a guide boss on each of said housing sides slanting parallel to said ramp faces, said retainer having a front facing said rear end, a rear, facing away from said rear end, and retainer sides therebetween, side plates on said retainer sides each having an elongated slot therein, which slot is adapted to receive therein a respective one of said guide bosses, a plurality of engaging portions on said retainer and between said side plates, each of said engaging portions having a guide face parallel and complementary to said elongated slot and adapted to secure terminals in respective ones of said cavities, whereby said retainer, when moving between said temporary position and said secured position, is guided by said ramp face when said guide bosses are received in said elongated slots, thereby to mount said retainer on said housing, said guide faces guiding said terminals as they enter said cavities when said retainer is in said temporary position and moving to said secured position, wherein second engaging elements are adapted to lock said retainer in said secured position.

2. The connector of claim 4 wherein said retainer is hinged to said housing.

* * * * *